US006888401B1

(12) United States Patent
Tanase

(10) Patent No.: US 6,888,401 B1
(45) Date of Patent: May 3, 2005

(54) CURRENT MODE CURRENT SENSE CIRCUITS AND METHODS

(75) Inventor: Gabriel Eugen Tanase, Cupertino, CA (US)

(73) Assignee: Maxim Integrated Products, Inc., Sunnyvale, CA (US)

( * ) Notice: Subject to any disclaimer, the term of this patent is extended or adjusted under 35 U.S.C. 154(b) by 0 days.

(21) Appl. No.: 10/603,890

(22) Filed: Jun. 25, 2003

(51) Int. Cl.[7] ..... G05F 1/10; G05F 3/02
(52) U.S. Cl. ..... 327/538; 327/543
(58) Field of Search ..... 327/538, 540, 327/541, 543, 427, 434, 437; 323/312, 315, 317

(56) References Cited

U.S. PATENT DOCUMENTS 4,471,292 A * 9/1984 Schenck et al. ..... 323/315
4,958,123 A * 9/1990 Hughes ..... 323/316
5,801,523 A * 9/1998 Bynum ..... 323/315

OTHER PUBLICATIONS

Fairchild Semiconductor Corporation KA5M0965Q Fairchild Power Switch (FPS) Data Sheet, 2001, pp. 1–12.

* cited by examiner

*Primary Examiner*—Tuan T. Lam
(74) *Attorney, Agent, or Firm*—Blakely, Sokoloff, Taylor & Zafman LLP

(57) ABSTRACT

Current mode current sense circuits and methods that may provide a current output proportional to the sensed current, and that provide current sensing at a fixed voltage drop. Sensing is by way of a transistor coupled in series with the load, with circuitry clamping the voltage drop across the transistor to a predetermined level, and providing a current output proportional to the current in that transistor. Various embodiments are disclosed, including circuits for high side and low side sensing, and which are capable of operation in the presence of short circuits.

14 Claims, 4 Drawing Sheets

CURRENT MODE CURRENT SENSE CIRCUITS AND METHODS

BACKGROUND OF THE INVENTION

1. Field of the Invention

The present invention relates to the field of current sensing circuits and methods.

2. Prior Art

The common prior art technique used for current sensing is based on a sense resistor. The sense resistor is placed in series with the load whose current is to be sensed, with the sensed current developing a voltage across the resistor (see FIG. 1). The voltage is amplified and delivered at the output. This current measurement technique is "voltage mode", as the input signal is a voltage ($V_{SENSE}$): $V_{OUT}=A\cdot V_{SENSE}$, where $V_{SENSE}=R1\cdot I_{IN}$.

DETAILED DESCRIPTION OF THE PREFERRED EMBODIMENTS

In the description to follow, the basic principles of the present invention shall be described in relation to high side unidirectional current sense circuits as perhaps being the most common application thereof. However, the invention is not so limited, as shall subsequently be described, as the same is applicable to low side sensing and/or bi-directional current sensing.

Figure 2:
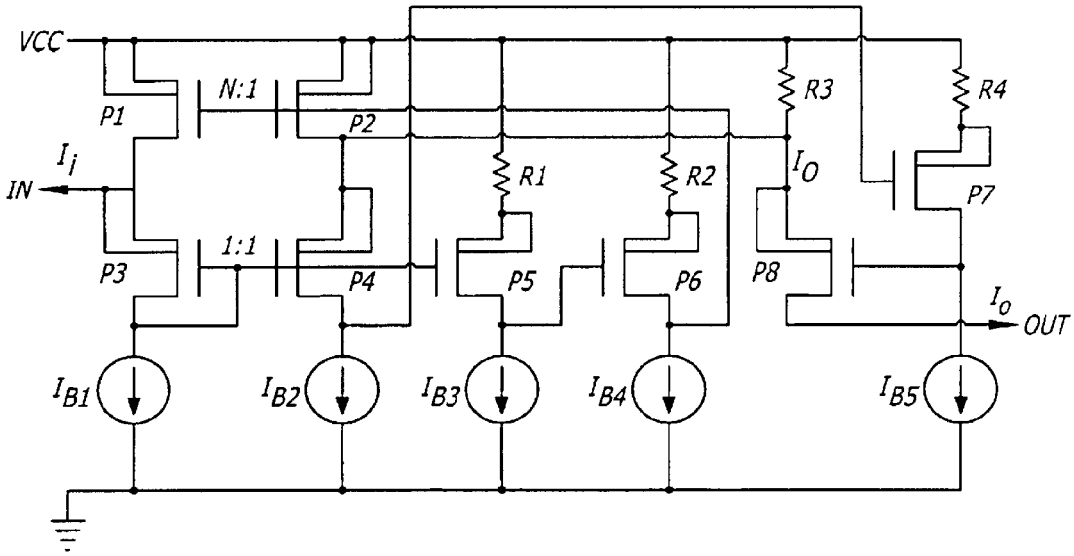
FIG. 2 is a circuit diagram for one embodiment of a current mode current sensing circuit using p-channel transistors in accordance with the present invention.

Now referring to FIG. 2, one embodiment of the present invention may be seen. In this embodiment, for simplicity and not as a necessity, it will be assumed that the current sources are equal, that is:

$$I_{B1}=I_{B2}=I_{B3}=I_{B4}=I_{B5}=I_B$$

However, in the description to follow, for greater clarity, frequently a specific current source will be referred to rather than simply $I_B$ generally. Also it is assumed that p-channel transistors P3 through P7 are matched transistors having the same W/L ratio and sizes. Also, p-channel transistors P1 and P2 are assumed matched by the ratio N, with transistor P1 being N times the size of transistor P2, where N can be less than, equal to or more frequently, substantially greater than 1.

The load or current drawing component or circuit (herein generally referred to simply as the load) is connected between the terminals IN and GND. Consequently, the entire current provided to the load from the power supply VCC flows through p-channel transistor P1. With the foregoing assumptions, the voltage at the source of transistor P5 is equal to R1 times $I_{B3}$, or $R1*I_B$. Since current sources $I_{B1}$, $I_{B2}$ and $I_{B3}$ are equal and transistors P3, P4 and P5 are matched, all three transistors will have the same source to gate voltage, and thus the same source voltage. Consequently the input voltage VIN will be equal to the VCC minus the voltage drop across resistor R1, namely $VIN=VCC-R1*I_B$.

Also, transistors P1 and P2 will have the same source to drain voltages, so that the current in transistor P2 mirrored or replicated from transistor P1 will be N times less than the current in transistor P1, namely $(I_{IN}+I_{B1})/N$. If the current through transistor P3 varies from $I_{B1}$, the gate voltages on transistors P3, P4 and P5 will change, changing the current through resistor R1. The current difference between the current through resistor R1 and current source $I_{B3}$ is coupled to the gate of transistor P6. This disturbs the current balance between the current through resistor R2 and current source $I_{B4}$, with the difference being fed back to control the gate voltages of transistors P1 and P2 to rebalance the circuit. Thus, transistors P1, P2, P3, P5 and P6 form a first closed loop.

Since the current in transistor P2 is $(I_{IN}+I_{B1})/N$, and the current through transistor P4 is only $I_{B2}$, the current passed to the source of transistor P8 is $(I_{IN}+I_{B1})/N-I_{B2}$. Also, because transistors P3, P4 and P5 are matched and conduct equal currents, the voltage drop across resistor R3 will be the same as the voltage drop across Resistor R1. Consequently the current through resistor R3 will be $I_B*R1/R3$.

The total current $I_O$ through transistor P8 to the out put will be:

$$I_O=(I_{IN}+I_B)/N-I_B+I_BR1/R3)$$

$$=I_{IN}/N+I_B(R1/R3+1/N-1)$$

Thus, the output current $I_O$ varies linearly with the input current $I_N$. The input voltage $VIN=(I_B*R1)$ is independent of the input current, and can be set as low as the size of the sense device (P1) allows. Also if:

$$R1/R3=1-1/N$$

then the output current is proportional to the in put current as follows:

$$I_O=I_i/N$$

In the circuit of FIG. 2, if transistor P8 conducts less than the above output current, then the excess current through transistor P2 will cause the source voltage of transistor P4 to increase so that transistor P4 will conduct current in excess of $I_{B2}$. This raises the voltage on the gate of transistor P7, reducing the current flow in resistor R4 so that the current source $I_{B5}$ will pull down the voltage on the gate of transistor P8 to increase the current flow through transistor P8. Thus, transistors P1, P2, P3, P4, P7 and P8 form a second closed loop to provide an output current independent of the output voltage as stated before, thereby providing a very high impedance current source output.

Figure 1:
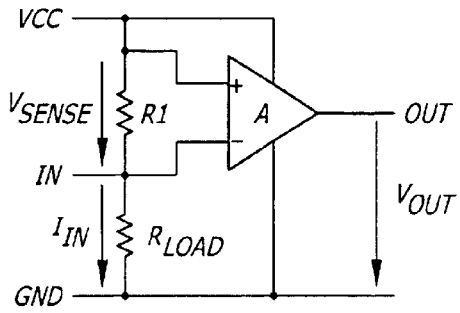
FIG. 1 (Prior Art)
FIG. 1 is a circuit diagram illustrating a prior art voltage mode current sense circuit.

The circuit of FIG. 2 may be modified to sense current not between VCC and IN, but rather between IN and GND by flipping the circuit over and substituting n-channel devices for the p-channel devices of FIG. 1 (the direction of the current sources not being changed).

Figure 3:
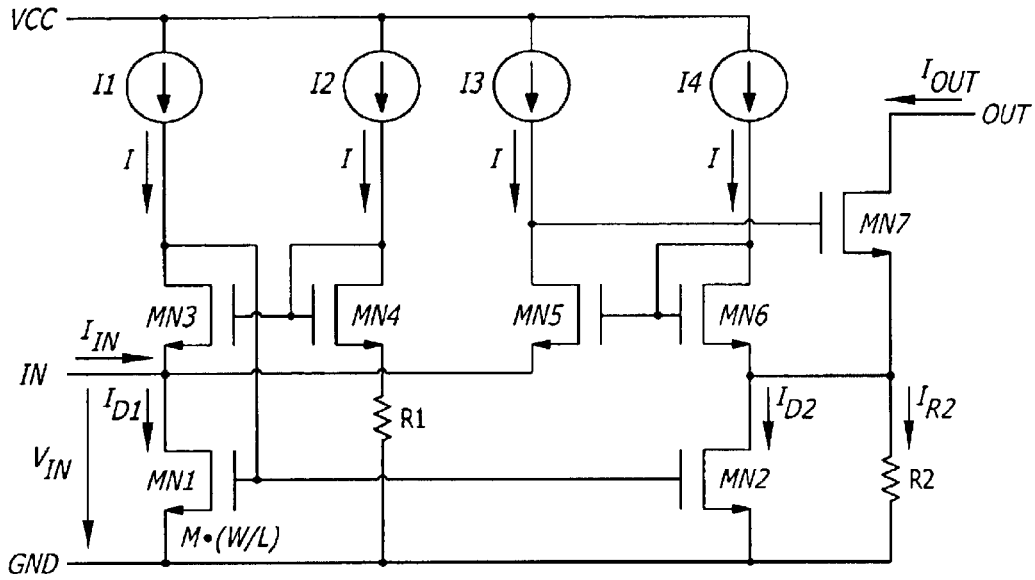
FIG. 3 is an embodiment similar to that of FIG. 2, but using n-channel transistors instead of n-channel transistors.

FIG. 3 presents another embodiment of a current mode current sensing circuit in accordance with the present invention. This circuit using n-channel transistors is also based on the matching properties of two MOS devices having the same $V_{DS}$ and $V_{GS}$ voltage. Transistor MN1 is scaled to transistor MN2 by a multiple of M. Thus transistor MN1 may consist of M transistors, each identical to transistor MN2. For simplicity of explanation, though as shall be ovbvious to one skilled in the art, not as a limmitation of the invention, assume that current sources 11, 12, 13 and 14 force the same current I into the respective nodes. It is also assumed that transistors MN3, MN4 and MN5, MN6 are, respectively, matched.

The circuit comprises two negative feedback loops. One loop consists of transistors MN1, MN2 and MN4. This loop sets the voltage at the input, IN. Assuming $V_{GS3}=V_{GS4}$, $V_{IN}=I\cdot R1$. The second loop consists of transistors MN5, MN6 and MN7. This loop enables the same $V_{DS}$ for both transistors MN1 and MN2, assuming that $V_{GS5}=V_{GS6}$. Due to negative feedback, the output current, $I_{OUT}$, is:

$$I_{OUT}=I_{D2}+I_{R2}-I$$

Assuming that $V_{GS5}=V_{GS6}$ and $V_{GS3}=V_{GS4}$, $I\cdot R1=I_{R2}\cdot R2$. The current $I_{D1}$ is set by the currents flowing at IN node:

$$I_{D1}=I_{IN}+2\cdot I$$

Based on scaling between transistors MN1 and MN2, $I_{D2}=I_{D1}/M$. Using the results for $I_{D1}$, $I_{D2}$ and $I_{R2}$ the output current expression becomes: $I_{OUT}=I_{IN}/M+I\cdot(R1/R2+2/M-1)$ If resistors R1 and R2 satisfy the condition $R1/R2=1-2/M$, then $I_{OUT}=I_{IN}/M$. Thus the circuit in FIG. 2 senses the input current $I_{IN}$, and may generate an output current $I_{OUT}=I_{IN}/M$. Additionally, the circuit sets the voltage at the input $V_{IN}=I\cdot R1$, independent of the input current $I_{IN}$.

Figure 4:
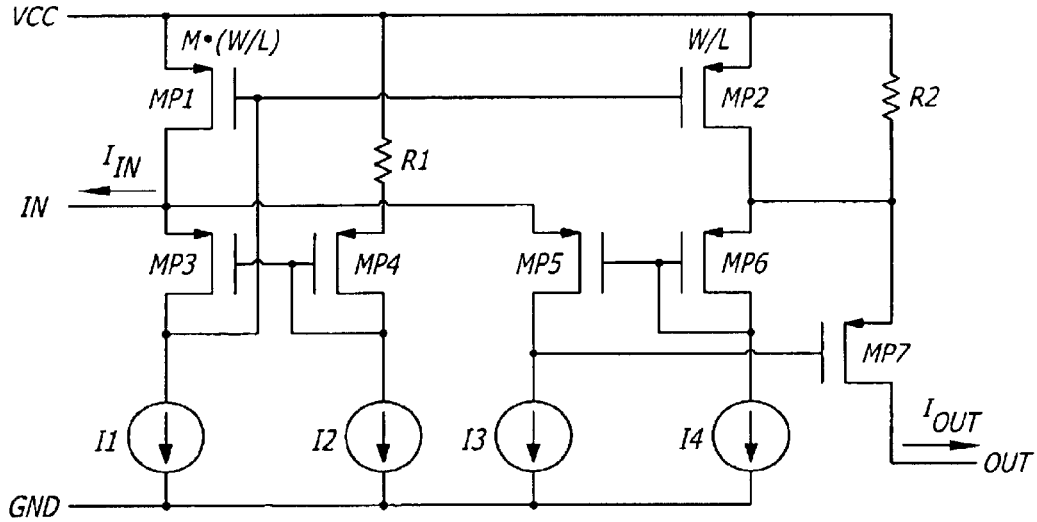
FIG. 4 is a circuit diagram for a modified version of the current mode current sensing circuit of the present invention using p-channel transistors.

FIG. 4 is an embodiment similar to that of FIG. 3, but using p-channel transistors instead of n-channel transistors. Thus the circuit of FIG. 3 senses current between IN and GND while the circuit of FIG. 4 senses current between VCC and IN.

Figure 5:
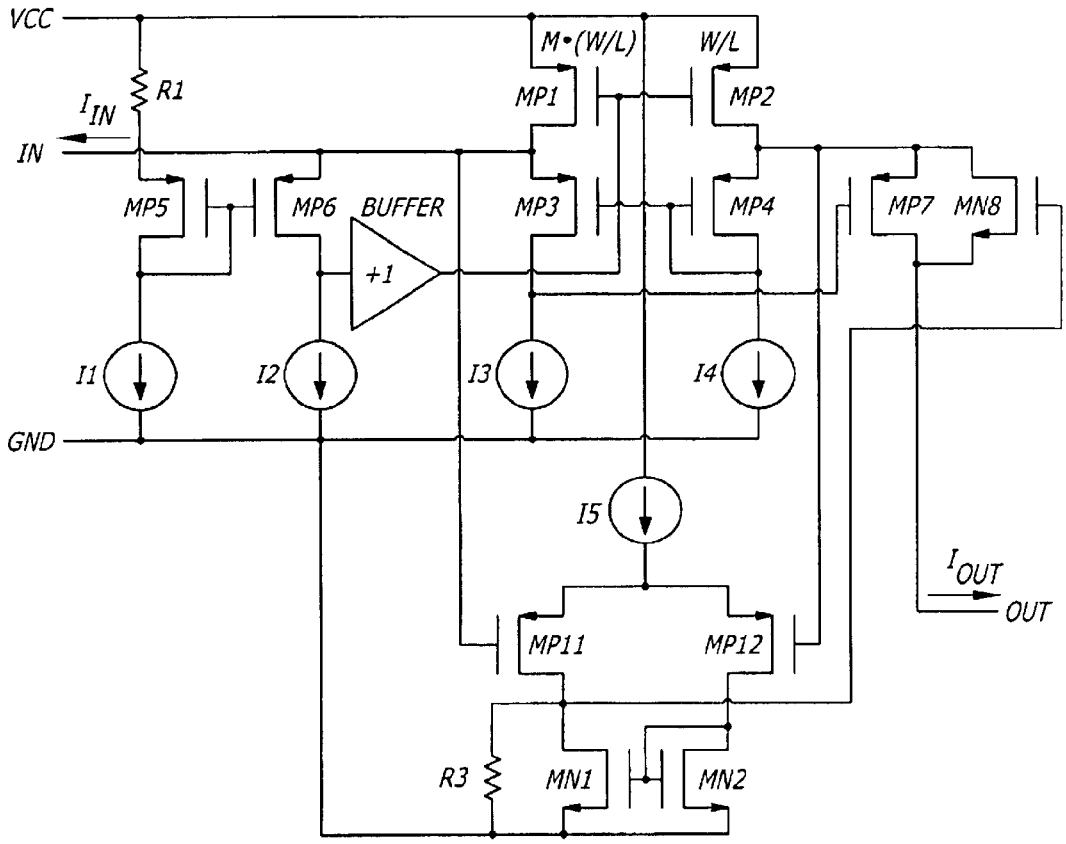
FIG. 5 is an embodiment for minimizing the error that may occur if the input becomes shorted.

FIG. 5 is a circuit diagram for a modified version of the current mode current sensing circuit of the present invention using p-channel transistors. This circuit is able to measure the input current $I_{IN}$ when the input IN is shorted to ground GND. In normal operation (no short-to-GND), the voltage at the input is set such that $V_{CC}-V_{IN}=I\cdot R1$. The input current $I_{IN}$ is sensed by transistor MP1 and then scaled at the output through transistor MP2, i.e. $I_{OUT}=I_{IN}/M$. The buffer provides fast charging of the gate-source capacitances of transistors MP1 and MP2. The block composed of transistors MP11, MP12, MN1, MN2 and MN8 acts as a supplemental negative feedback loop in parallel with the loop composed of transistors MP3, MP4 and MP7. The supplemental loop is active when the input (IN) is electrically pulled down to GND. Then transistor MP6 is off and the gates of transistors MP1 and MP2 are pulled to GND. Transistor MP3 is off and the loop formed of transistors MP3, MP4 and MP7 is no longer able to achieve its function. At this point, the supplemental loop is active such that the potential at the drain of transistor MP2 follows the potential at the drain of transistor MP1, so that $V_{DS1}=V_{DS2}$. This can be achieved provided that $V_{OUT}\leqq V_{IN}$. However, $V_{OUT}$ is always greater than 0. Thus, if $V_{IN}=0$, the previous condition cannot be met. Consequently under these conditions, $V_{DS1}>V_{DS2}$. Therefore, if input (IN) is shorted to ground (GND), current scaling accuracy of transistors MP1 relative to transistor MP2 is affected by the different drain-source voltage $V_{DS1}$, $V_{DS2}$ values. However, the error can be minimized if the voltage at the output (OUT) is small (10 mV to 100 mV range) compared to the supply voltage (>1.8V). This can be possible using the circuit presented in FIG. 6.

Figure 6:
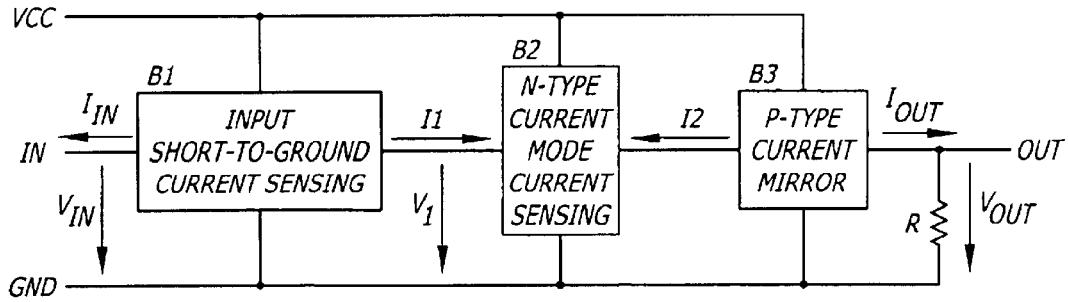
FIG. 6 is a diagram showing the circuit architecture that may be used for precision current sensing of the current delivered to a load connected between IN and GND.

The circuit architecture presented in FIG. 6 is used for precision current sensing of the current delivered to a load connected between IN and GND. In normal operation (no input short-to-ground), the voltage drop between VCC and IN is set by the block B 1 (see FIG. 5). The voltage V1 is set by the block B2 (see FIG. 3). The block B3 transfers I2 current to the ouput ($I_{OUT}$=I2). This allows current to voltage conversion through the resistor R. The output voltage $V_{OUT}$ is proportional to the input current $I_{IN}$ over a wide range. Three to six decades of input current variation can be covered.

Figure 7:
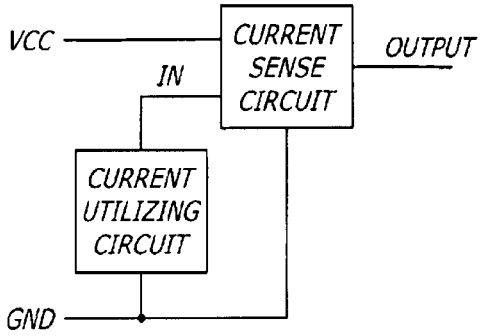
FIG. 7 illustrates the connection of a current mode current sense circuit such as that of FIG. 2 between the positive power supply terminal and a current utilizing circuit (load).
Figure 8:
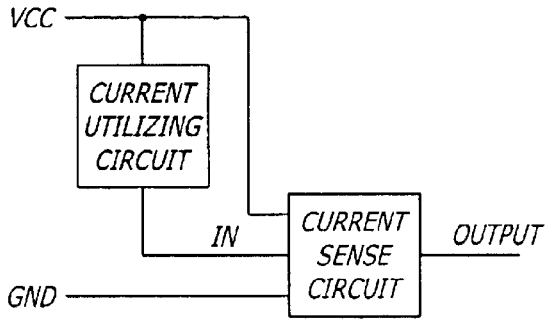
FIG. 8 illustrates the connection of a current mode current sense circuit such as that of FIG. 3 between the current utilizing circuit (load) and a circuit ground.
Figure 9:
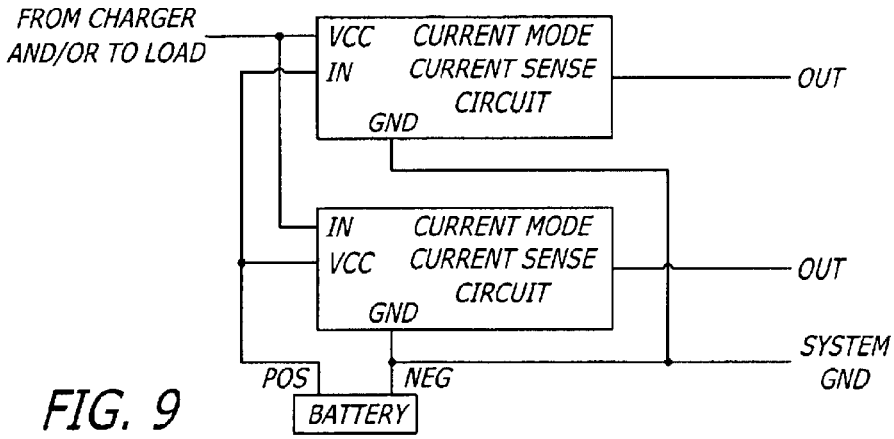
FIG. 9 illustrates the use of two "high side" current mode current sense circuits coupled in parallel to sense both positive and negative currents.

FIG. 7 illustrates the connection of a current mode current sense circuit such as that of FIG. 2 between the positive power supply terminal and a current utilizing circuit (load), while FIG. 8 illustrates the connection of a current mode current sense circuit such as that of FIG. 3 between the current utilizing circuit (load) and a circuit ground. Two circuits in accordance with the present invention may also be used to sense bi-directional current. By way of example, FIG. 9 illustrates the use of two "high side" current mode current sense circuits coupled in parallel as part of an exemplary battery circuit wherein charging and discharging currents may be sensed.

Figure 10:
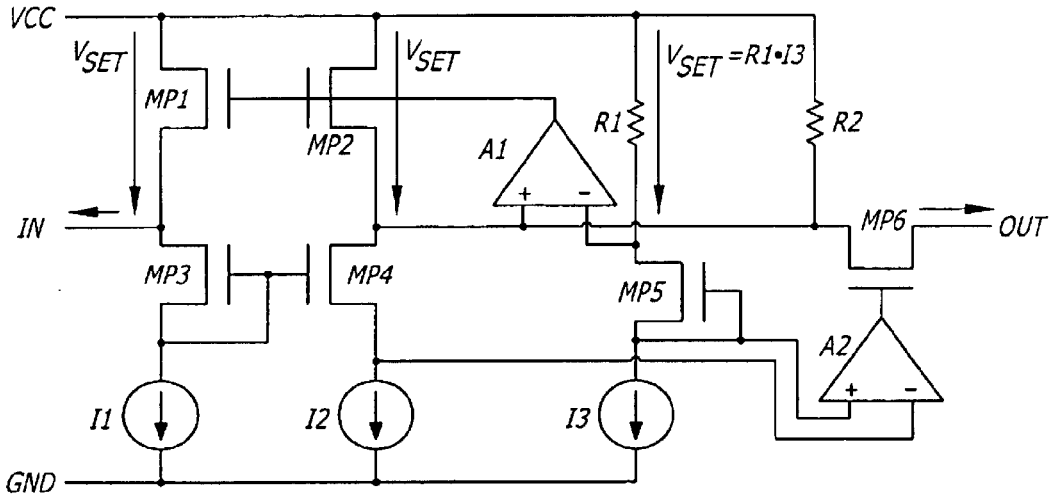
FIG. 10 presents a simplified diagram of one embodiment of the present invention.

FIG. 10 presents a simplified diagram of an embodiment of the present invention. While I1, 12 and 13 may be equal current sources with p-channel transistors MP3 and MP4 being matched transistors (including size), this is not a requirement. If the current sources 11 and 12 are in the ratio of the size of transistors MP3 and MP4 (so that the transistors have the same current density), the voltage of the sources of transistors MP3 and MP4 will be equal. Since amplifier A1 forces the voltage of the source of transistor MP4 to equal VCC minus the voltage drop across resistor R1 (which is I3*R1), and the source voltages of transistors MP3 and MP4 are equal, the amplifier indirectly forces the voltage on the terminal IN to also equal VCC minus the voltage drop across resistor R1.

In preferred designs, the ratio of the current sources I1 and I2 and the ratio of the size of transistors MP3 and MP4, if not one to one, will not be large. With transistor MP1 being N times as large as transistor MP2 where N is usually substantial, when the current IN is zero, the current through transistor MP2 will be I1/N. Picking the value of resistor R2 to supply a current to transistor MP4 of I2−I1/N, the current if $I_1=I_2=I_3$ $$R1/R2=1-1/N$$

for any values of $I_1$, $I_2$ and $I_3$:

$$R2 = R1\frac{I3}{I2 - \frac{I1}{N}}$$

As current IN is supplied to a load connected to the IN terminal, the current through transistor MP2 will increase by IN/N, all of which will be provided to the output OUT through transistor MP6. Note that the output OUT is a high impedance current source output. In particular, assume that a steady current IN is being supplied to a load, but that the voltage on the OUT terminal suddenly decreases. This suggests that more of the current through transistor MP2 will be delivered to the output OUT. However, if the current through transistor MP4 decreases, current source 12 will pull the negative input to amplifier A2 lower, reducing the current through transistor MP6 as required to maintain the current through transistor MP4 equal to the current through current source 12. Thus, amplifier A2 and current source MP6 act as a current regulator, maintaining the current at the output OUT equal to IN/N, independent of the voltage on the output terminal OUT.

The embodiments disclosed herein have been MOS embodiments. Preferably in other embodiments, the input devices will also be MOS devices, though other parts of the circuit may be comprised of bipolar transistors, as desired.

While certain preferred embodiments of the present invention have been disclosed herein, such disclosure is only for purposes of understanding the exemplary embodiments and not by way of limitation of the invention. It will be obvious to those skilled in the art that various changes in form and detail may be made in the invention without departing from the spirit and scope of the invention as set out in the full scope of the following claims.

What is claimed is:

1. A current sense circuit comprising:

first and second transistors, each having first and second terminals and a control terminal;

the conduction through each transistor between the first and second terminals being controlled by the voltage between the control terminal and the first terminal of the respective transistor;

the first transistor having its first and second terminals configured to connect in series with a first power supply terminal and a load;

the first terminal of the second transistor being connected to the first terminal of the first transistor, and the control terminal of the second transistor being connected to the control terminal of the first transistor;

a first control loop responsive to a reference voltage to clamp the first to second terminal voltages of the first and second transistors to a predetermined voltage; and, a second control loop providing a sense circuit output current linearly varying with the current through the second transistor.

2. The current sense circuit of claim 1 where the second control loop has a high output impedance.

3. The current sense circuit of claim 1 wherein the first transistor is N times larger than the second transistor, wherein N is substantially greater than one.

4. The current sense circuit of claim 3 wherein the second control loop provides a sense circuit output current component equal to the current through the second transistor minus a bias current on the second transistor.

5. The current sense circuit of claim 4 wherein the second control loop includes biasing circuitry biasing the sense circuit output current to a zero current when a load current is zero.

6. The current sense circuit of claim 1 wherein the second control loop is not active when the voltage on the load connection to the first transistor approaches the voltage of a second power supply terminal, and further comprising a third control loop, the third control loop providing a sense circuit output current linearly varying with the current through the second transistor when the voltage on the load connection to the first transistor approaches the voltage of a second power supply terminal.

7. The current sense circuit of claim 1 further comprising: an another current sense circuit comprising:

third and fourth transistors, each having first and second terminals and a control terminal, the conduction through each transistor between the first and second terminals being controlled by the voltage between the control terminal and the first terminal of the respective transistor;

the third transistor having its first and second terminals configured to connect in series with a second power supply terminal and a load;

the first terminal of the fourth transistor being connected to the first terminal of the third transistor, and the control terminal of the fourth transistor being connected to the control terminal of the third transistor;

a first control loop responsive to a reference voltage to clamp the first to second terminal voltages of the third and fourth transistors to a predetermined voltage; and, a second control loop providing a sense circuit output current linearly varying with the current through the fourth transistor; and, the output current of the another sense circuit being coupled to flow between the first and second terminals of the third transistor.

8. The current sense circuit of claim 7 wherein the first power supply terminal is a positive power supply terminal and the second power supply terminal is a negative power supply terminal relative to the positive power supply terminal.

9. The current sense circuit of claim 7 further comprised of a current mirror coupled to the output of the another current sense circuit, and a resistor coupled to the output of the current mirror.

10. A method of sensing current using transistors, each having first and second terminals and a control terminal, the current flow between the first and second terminals being controlled by the voltage between the control terminal and the first terminal, comprising:

coupling the first and second terminals of the first transistor in series with a source of power and a load;

using a first control loop responsive to a set voltage, mirroring a current proportional to the current through the first transistor to a second transistor while maintaining the voltages between the control terminal and the first terminal of the first and second transistors equal; and also maintaining the voltages between the first and second terminals of the first and second transistors equal; and, providing a current sense output responsive the current between the first and second terminals of the second transistor.

11. The method of claim 10 wherein the current sense output is provided by a second control loop, the second control loop providing a current sense output current changing linearly with and equal to changes in current between the first and second terminals of the second transistor.

12. The method of claim 11 further comprised of including a bias current in the current sense output current to make the current sense output current equal to zero when the load current is zero.

13. A method of current sensing comprising:

providing first and second transistors, the first transistor being N times the size of the second transistor;

passing the current to be sensed through the first transistor;

controlling the first and second transistors so that the voltages across the first and second transistors are equal to a reference voltage and independent of the input current to replicate the current in the first transistor in the second transistor in a ratio of 1/N; and, providing an output that varies linearly proportional to the current in the second transistor.

14. The method of claim 13 wherein the first and second transistors are biased by bias current sources.

* * * * *